US005244360A

United States Patent [19]

Lefebvre

[11] Patent Number: 5,244,360

[45] Date of Patent: Sep. 14, 1993

[54] HYDRAULICALLY CONTROLLED DIAPHRAGM PUMP FOR HIGH PRESSURES

[75] Inventor: Rémy Lefebvre, Radepont-Fleury S/Andelle, France

[73] Assignee: Dosapro Milton Roy, Pont-Saint-Pierre, France

[21] Appl. No.: 805,636

[22] Filed: Dec. 12, 1991

[30] Foreign Application Priority Data

Dec. 18, 1990 [FR] France ..... 90 15831

[51] Int. Cl.[5] ..... F04B 43/06

[52] U.S. Cl. ..... 417/383; 417/395; 417/63; 92/98 R

[58] Field of Search ..... 417/383, 385, 386, 387, 417/388, 395, 63, 413; 92/97, 98 R, 5 R

[56] References Cited

U.S. PATENT DOCUMENTS

| | | | |
|---|---|---|---|
| 2,689,586 | 9/1954 | Anderson | 92/97 |
| 3,131,638 | 5/1964 | Wilson et al. | 92/5 R |
| 3,563,138 | 2/1971 | Symonds | 92/97 |
| 3,566,750 | 3/1971 | Allen | 92/97 |
| 3,722,373 | 3/1973 | Beach et al. | 92/97 |
| 3,895,524 | 7/1975 | Jurovsky | 92/97 |
| 4,208,031 | 6/1980 | Jonak | 92/97 |
| 4,883,412 | 11/1989 | Malizard et al. | 417/387 |
| 5,145,331 | 9/1992 | Goes et al. | 417/383 |

FOREIGN PATENT DOCUMENTS

| | | | |
|---|---|---|---|
| 992556 | 10/1951 | France . | |
| 1373780 | 4/1964 | France . | |
| 2180213 | 10/1973 | France . | |
| 2533636 | 3/1984 | France . | |
| 1211453 | 2/1986 | U.S.S.R. | 417/388 |
| 305235 | 2/1928 | United Kingdom | 417/383 |

*Primary Examiner*—Richard A. Bertsch
*Assistant Examiner*—Peter Korytnyk
*Attorney, Agent, or Firm*—Griffin Butler Whisenhunt & Kurtossy

[57] ABSTRACT

In a hydraulically controlled diaphragm pump for high pressures, the diaphragm situated between the hydraulic control chamber and the working chamber is composite and comprises two thin metal diaphragms having between them an intermediate diaphragm that is thick, is made of synthetic material, has high crushing strength, and is in the form of an elastically deformable vault whose concave side faces towards the working chamber.

4 Claims, 1 Drawing Sheet

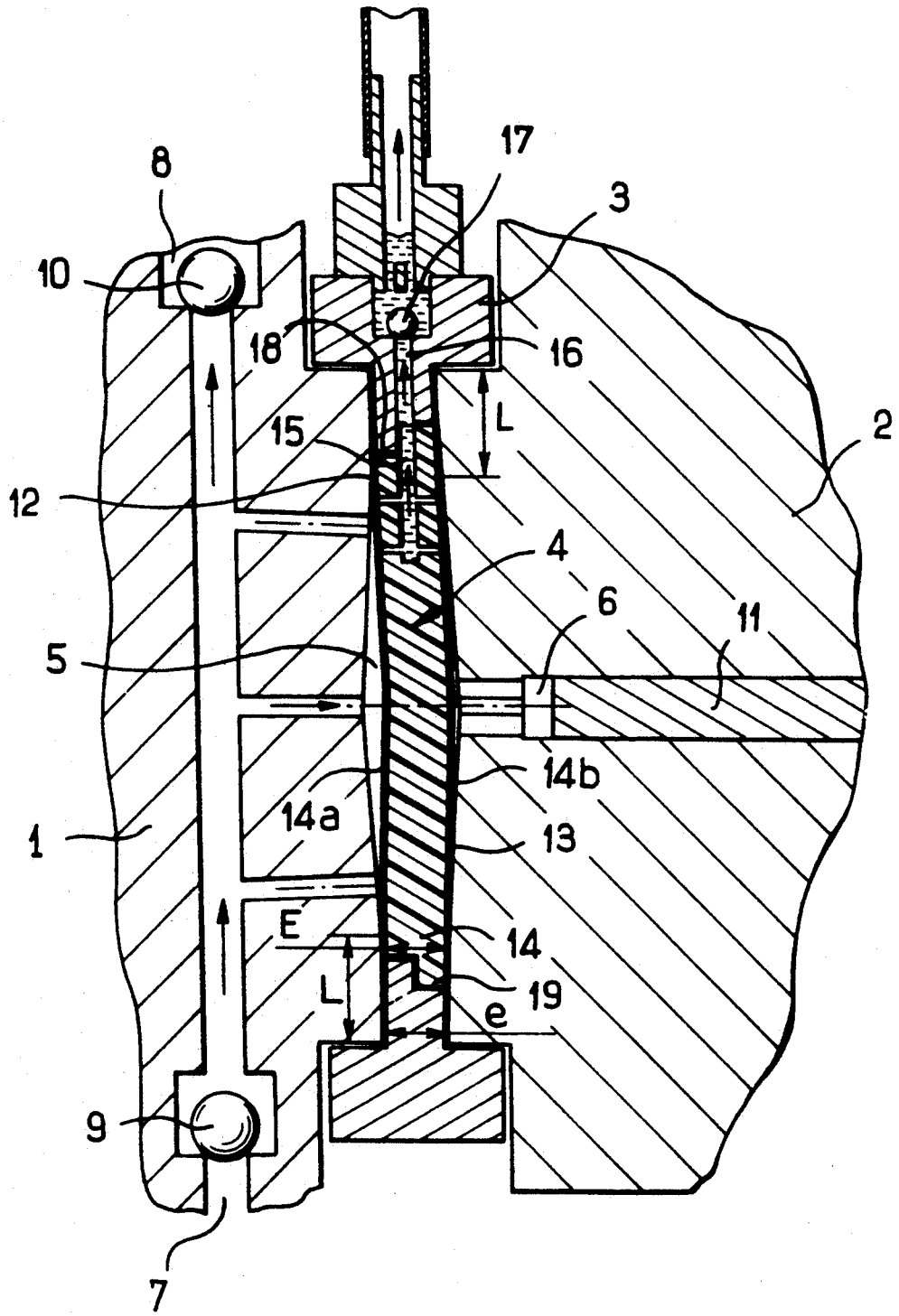
8
10
17
3
18
16
L
15
2
12
4
6
11
5
14b
14a
13
1
E
14
L
19
e
9
7

HYDRAULICALLY CONTROLLED DIAPHRAGM PUMP FOR HIGH PRESSURES

BACKGROUND OF THE INVENTION

A hydraulically controlled diaphragm pump for high pressures generally includes a thin metal diaphragm (made of stainless steel) which is deformable in its center in non-elastic manner, and which is disposed between a hydraulic control chamber and a working chamber. The amplitude with which the center of the diaphragm can be displaced is limited such that, other things being equal, obtaining a high flow rate requires the pump to operate at a high speed. This causes diaphragms to age fairly quickly, possibly leading to breakage so that the pumped fluid (which is generally aggressive) becomes mixed with the hydraulic chamber fluid which may rapidly destroy the pump itself in addition to putting it out of operation. It is therefore advantageous in this type of pump to provide two diaphragms so as to obtain more reliable isolation between the two fluids and to install a device for detecting diaphragm breakage.

Double diaphragm pumps exist with spacer material being placed between the diaphragms and provided with channels to allow a fluid coming from one or other of the pump chambers through a broken one of the diaphragms to flow towards a breakage detection duct formed in the pump body and facing the spacer material. Because of the high pressures used, such a technique cannot be transposed to metal diaphragms. The intermediate material is highly compressed between the two thin diaphragms during the delivery stroke of the pump and is then decompressed during the suction stroke, and as a result it is subjected to alternating stresses that are damaging to its strength over time and that cause it to deteriorate quickly.

The object of the present invention is to provide a solution suitable for detecting diaphragm breakage in a metal diaphragm pump by installing an intermediate material which withstands high compression well without significant deformation and without spoiling the operation of the pump, in particular without spoiling its degree of suction.

SUMMARY OF THE INVENTION

To this end, the present invention therefore provides a hydraulically controlled diaphragm pump for high pressures, in which the diaphragm situated between the hydraulic control chamber and the working chamber is a composite and comprises two thin metal diaphragms having between them an intermediate diaphragm that is thick, is made of synthetic material, has high crushing strength, and is in the form of an elastically deformable vault whose concave side faces towards the working chamber. The thick intermediate diaphragm makes it possible to have an intermediate volume that does not collapse during the high pressure of delivery and which can therefore be monitored for detecting diaphragm breakage. This great thickness together with the stiffness of the material due to its capacity to withstand high compression without deformation constitutes a drawback for the suction stroke of the pump during which the power that is developed is limited by cavitation phenomena in the working hydraulic liquid. This drawback is overcome by the concave shape of the intermediate diaphragm at rest which constitutes a return spring for the diaphragm and which assists suction. To perform its monitoring function better, the thick diaphragm includes drainage channels establishing communication between each of its faces and a radial channel formed through the body of the pump for the purpose of detecting diaphragm breakage.

In a preferred embodiment of the invention, the body includes an annular spacer extending between the metal diaphragms outside the thick diaphragm, with a clamping zone extending over the spacer and over the periphery of the thick diaphragm.

BRIEF DESCRIPTION OF THE DRAWING

An embodiment of the invention is described by way of example with reference to the accompanying drawing which is a diagrammatic axial section through a pumping head in accordance with the invention.

DETAILED DESCRIPTION

The pumping head is defined by two portions 1 and 2 of a pump body and by a spacer 3 interposed therebetween. These items 1, 2, and 3 are axially clamped to one another, thereby clamping against a composite diaphragm 4 that is level with the annular spacer 3, which diaphragm is described in greater detail below. The composite diaphragm constitutes the moving dividing wall between a working (or pump) chamber 5 and a hydraulic control chamber 6. In conventional manner, the chamber 5 is connected to a suction duct 7 and to a delivery duct 8 via non-return valves 9 and 10. The fluid contained in the chamber 5 is thus delivered to the duct 8 when the diaphragm 4 is displaced to the left in the figure. Displacement to the right establishes suction of the fluid from the suction duct 7 via the valve 9.

The motion of the diaphragm 4 is driven by reciprocating displacement of a piston 11 in the hydraulic control chamber 6. The control fluid when pushed to the left in the figure displaces the diaphragm 4 likewise to the left (delivery). In its reverse stroke, the piston 11 establishes suction that returns the diaphragm to the right.

According to the invention, the composite diaphragm 4 comprises two metal outer diaphragms 12 and 13, e.g. made of stainless steel. They are thin so as to have a degree of non-elastic deformability. They are made so that their areas are greater than the area of a disk having the same diameter. The peripheral zone of each of these diaphragms is clamped between the annular spacer 3 and a respective one of the portions 1 and 2 of the pump body.

An intermediate diaphragm 14 is disposed between the two diaphragms 12 and 13. The diaphragm 14 is thick and it is shaped, i.e. when at rest it takes up a cup or cone shape shown in FIG. 1 with its concave face **14*a* facing the pumping chamber 5. This diaphragm is elastically deformable, i.e. under the effect of pressure on its convex face it tends to flatten and even to flex the other way. When the pressure ceases to be applied, the diaphragm 14** returns elastically to its initial shape. The material of the diaphragm is a synthetic material having high compression strength (about 500 kg/cm$^2$ without deforming). Examples of materials of this kind are substances known commercially under the names Delrin (polyacetate) or Arnite.

The thick diaphragm 14 is received inside the annular spacer 3 and it has channels 15 shown in the figure that establish communication between the concave and convex faces **14*a* and 14*b* of the diaphragm 14 and a diaphragm breakage detection duct 16 which is known per se, which is formed radially through the spacer 3, and which is fitted with a non-return valve 17**.

The thick diaphragm has a stepped outside surface 18 which is complementary to a stepped inside surface 19 of the spacer 3. The steps constitute a way of ensuring that the diaphragm 14 cannot be installed with its concave side facing the wrong way. A small amount of circumferential clearance exists between the spacer 3 and the diaphragm 4.

It will also be observed that the thickness E of the diaphragm 14 is slightly greater (by a few hundredths of a millimeter) than the thickness e of the spacer 3.

Finally, the zone where the composite diaphragm is clamped between the two portions 1 and 2 of the pump body is of sufficient width L to ensure that the force clamping the two portions 1 and 2 against the spacer 3 via the metal diaphragms 12 and 13 as applied by assembly draw bars (that are not shown and that are known per se) is exerted uniformly through the diaphragms against the periphery of the thick diaphragm 14.

On assembly, the space lying between the diaphragms may be filled with a liquid (a drop of oil suffices) or else, if so required by the application, the space may be left untouched and the pump is operated with progressively increasing load which has the effect of expelling excess filler liquid or air from between the diaphragms via the valve 17, with the liquid or the air being expelled via the clearances and the channels 15 between the diaphragms and the spacer 3 under the effect of the delivery pressure of the pump acting on either side of the composite diaphragm.

As mentioned above, the shape and the elasticity of the thick diaphragm 14 provides assistance during suction, thereby significantly increasing the degree of suction provided by such a pump, which suction may be as great as a water column of 10 meters.

In the event of a metal diaphragm breaking, liquid leaks out through the valve 17 during each delivery stroke and on being detected this can be used to trigger an alarm and/or to stop the pump.

I claim:

1. In a hydraulically controlled diaphragm pump for high pressures having a diaphragm disposed between two parts of a pump body having a hydraulic control chamber and a working chamber, the improvement comprising two external diaphragms and an intermediate diaphragm together forming a composite diaphragm which is clamped between the two parts of the pump body, said external diaphragms being made of thin metal and said intermediate diaphragm having a thickness greater than that of the external diaphragms and being made of synthetic material having a crushing strength sufficiently high that it is not deformable under the output pressure of the pump and in part is in the form of an elastically deformable cone with a concave side face which faces towards the working chamber.

2. A pump according to claim 1, wherein the intermediate diaphragm includes drainage channels establishing communication between said concave side face and convex side face thereof and a radial channel formed through the body of the intermediate diaphragm for detecting diaphragm breakage.

3. A pump according to claim 1 in which the pump body includes an annular spacer extending around the thick diaphragm between said two parts of the pump and the metal diaphragms, wherein a zone of said parts of the body where the diaphragm is clamped extends over the spacer and over a periphery of the thick diaphragm.

4. A pump according to claim 3, wherein the inside surface of the spacer is stepped, with the peripheral surface of the thick diaphragm being correspondingly stepped.

* * * * *